United States Patent [19]

Lamlee

[11] 4,240,858

[45] Dec. 23, 1980

[54] METHOD OF MAKING A HEXAFLEXAGON

[76] Inventor: Stewart Lamlee, 55 W. 86th St., New York, N.Y. 10024

[21] Appl. No.: 907,758

[22] Filed: May 19, 1978

Related U.S. Application Data

[63] Continuation of Ser. No. 723,325, Sep. 15, 1976, abandoned.

[51] Int. Cl.[3] ..... B31F 3/00

[52] U.S. Cl. ..... 156/211; 46/1 L; 156/226; 156/252; 273/155

[58] Field of Search ..... 156/211, 252, 253, 264–265, 156/513, 514, 226; 273/155; 46/1 L, 157, 36

[56] References Cited

U.S. PATENT DOCUMENTS

| | | | |
|---|---|---|---|
| 2,565,944 | 8/1951 | Bergstein | 156/211 X |
| 2,568,458 | 9/1951 | Nichols | 156/253 |
| 2,647,071 | 7/1953 | Schade | 156/252 |
| 3,518,785 | 7/1970 | Behr | 46/1 L |
| 3,611,617 | 10/1971 | Foster et al. | 46/1 L |
| 3,725,170 | 4/1973 | Doll | 156/264 X |
| 3,971,156 | 7/1976 | Lamlee | 273/155 X |

*Primary Examiner*—David A. Simmons
*Attorney, Agent, or Firm*—Brian L. Ribando

[57] ABSTRACT

A hexaflexagon or an interchangeable face device is made by first printing a desired pattern on both sides of a sheet of card stock. The printed sheet is then die cut to form a series of parallel rows of zigzag slots. The slotted sheet is then laminated on both sides with a clear, flexible sheet material such as mylar forming a sandwich. The sandwich is then cut to form rows of alternating triangles. A triangle row is then folded and the two end triangles of the row adhered together to form the hexaflexagon.

8 Claims, 10 Drawing Figures

FIG. 7.
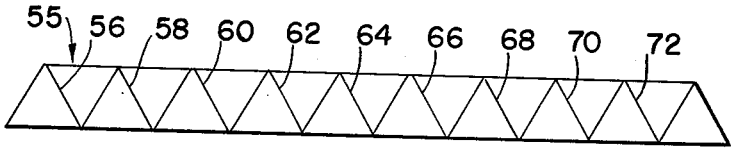
FIG. 8.
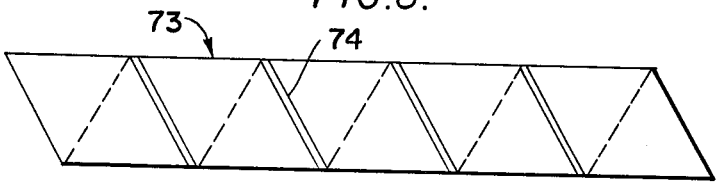
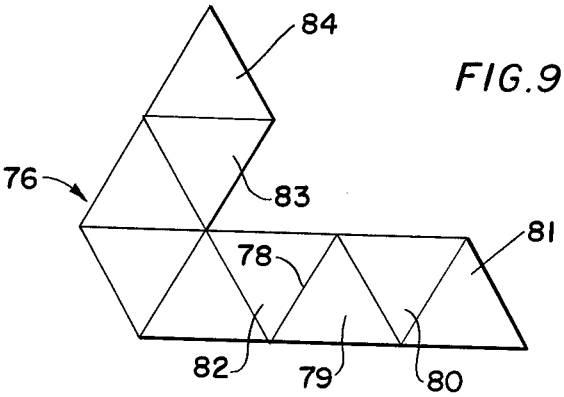
FIG. 9.
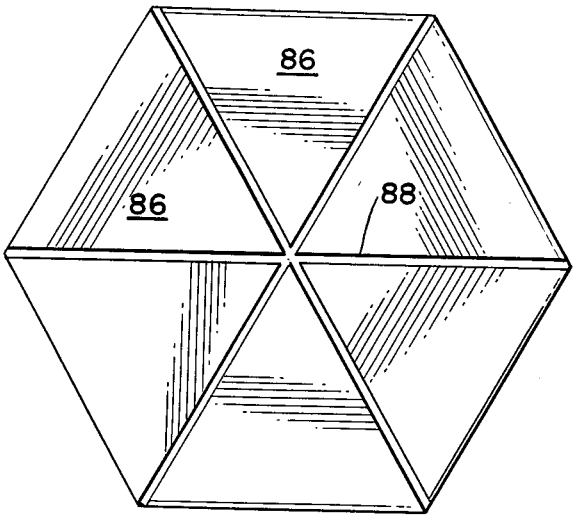
FIG. 10.

METHOD OF MAKING A HEXAFLEXAGON

This is a continuation of application Ser. No. 723,325 filed Sept. 15, 1976, now abandoned.

BACKGROUND OF THE INVENTION

A device which has changeable faces, or a hexaflexagon, is old in the art. Such devices present the appearance of a six-sided polygon but are in reality formed of 15, 19 or more triangular segments which are hinged together and connected to create a mobius strip. By proper manipulation of the triangular segments those triangles appearing on the surface of the polygon are made to change. Until the present time, no satisfactory way of manufacturing a hexaflexagon has been known. A single strip of stock material may be folded into triangular sections and the sections arranged to form a polygon. After limited use, however, this construction looses its structural integrity and the device becomes useless.

The U.S. patent to Lamlee, U.S. Pat. No. 3,971,156, discloses an improved method of making an interchangeable face device wherein a first printed series of triangles is adhered to one face of a binder strip and a second series of triangles is adhered to the opposite face of the strip. The binder strip then becomes the hinge element for the adjacent triangles. The present invention is directed to a new and improved method for making such a device.

SUMMARY OF THE INVENTION

A hexaflexagon is made from a strip of adjacent triangles connected to one another by flexible sheets adhered to both sides thereof. A sheet of stock material is first printed with a desired pattern, it being understood that the sheet will thereafter be cut and separated to form a plurality of devices. The printed sheet is die cut to form a sheet having a series of parallel rows of zigzag slots, the areas between the slots of each row forming triangles. The slotted sheet is laminated on both sides with a clear, flexible material such as mylar. The mylar sheets fill the interstices between adjacent triangles and form a hinge therebetween. As an alternative step, a coating may be applied as by dipping or spraying so that the coating covers the sheet and fills the slots to form the required hinge elements. The laminated or coated sheet is then cut to form rows of triangles, the triangles in each row being connected together by hinges. The cutting may be done by a knife drawn along the surface of the laminated sandwich, or by a cutting die. The rows of triangles are folded and the first and last triangle adhered together to form a hexaflexagon.

It is therefore an object of this invention to provide a method for making a hexaflexagon.

It is another object of this invention to provide a method for making a hexaflexagon wherein sheets of material adhered to one or both sides of a sheet of slotted stock fills the slots and creates hinge regions between adjacent triangles.

It is yet another object of this invention to provide a method whereby a sheet of slotted stock laminated with sheets of flexible stock are cut to form rows of triangles which may be folded and adhered together to form a hexaflexagon.

It is another object of this invention to provide a method including die cutting a sheet of stock to form parallel rows of zigzag slots, laminating a sheet of material to either side of said die cut sheet, and cutting said sheet to form rows of triangles with hinge elements between the triangles of each row.

These and other objects of the invention will be apparent from the description given below taken in conjunction with the accompanying drawing figures.

BRIEF DESCRIPTION OF THE DRAWINGS

FIG. 7 shows a row or chain of triangles prior to being folded into final configuration.

FIGS. 8 and 9 show intermediate steps in the folding of the triangle chain.

FIG. 10 shows a chain of triangles folded into a final form.

DESCRIPTION OF THE PREFERRED EMBODIMENT

Figure 1:
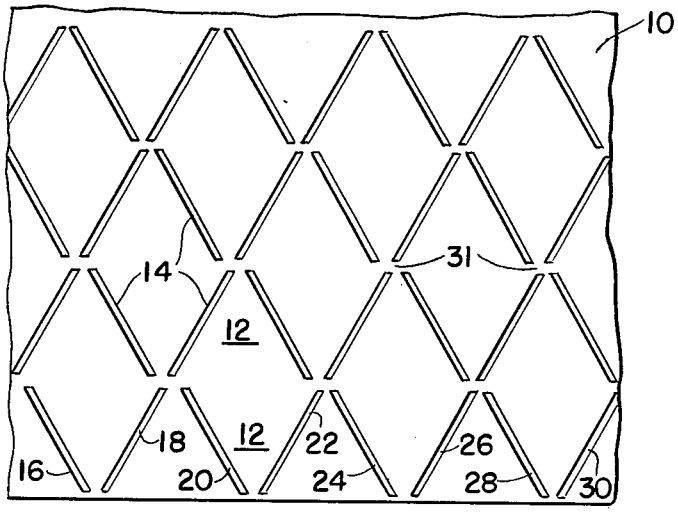
FIG. 1 shows a sheet of stock material which has been die cut to form parallel rows of slots.

Referring to FIG. 1, a sheet 10 of stock material is shown. This sheet may be ordinary card stock, cardboard, plastic, such as pvc, pva, or acetate, or any other thin opaque or transparent material which is relatively rigid. The sheet may be printed with an indicia which is suited to the product which is being made. Such indicia may include graphics, puzzles, cartoons, and the like. The printed sheet is then die cut so that parallel rows 12 of zigzag slots 14 are formed. A row of slots is shown as comprising adjacent slots 16, 18, 20, 22, 24, 26, 28 and 30 which are arranged in a zigzag pattern. It will be seen that other parallel rows are formed in the cutting operation. It is essential that the cutting be through the entire thickness of the stock sheet 10 and that the waste material from within the slots be removed. The remainder of the sheet retains a self-sustaining planar form due to card segments or webs 31 which are located between adjacent slot ends.

Figure 2:
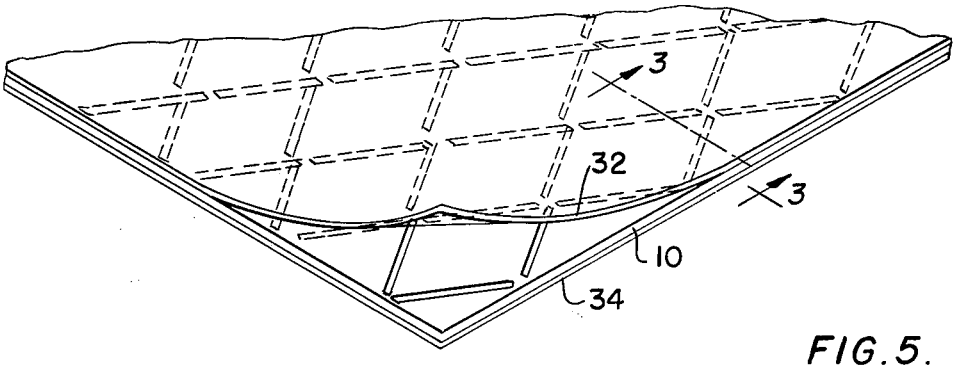
FIG. 2 shows the die cut sheet having a second and third sheet of material laminated on either side thereof forming a sandwich.

Turning now to FIG. 2, it will be seen that second and third sheets 32 and 34 respectively, are laminated to the die cut sheet 10. These sheets may be any transparent and flexible material such as mylar. The mylar may be adhered to the sheet 10 by any one of a number of conventional techniques which are known in the art. The mylar may be coated with a heat or pressure sensitive adhesive. The adhesive used must be flexible when set for reasons which are explained below. In an alternative embodiment (not shown) the mylar may be adhered to only one side of the die cut sheet 10.

Figure 3:
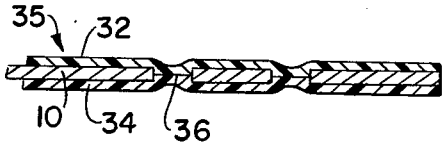
FIG. 3 is a sectional view taken along line 3—3 of FIG. 2 showing the layers of the laminated sandwich.

The composite sandwich 35 is shown in section at FIG. 3. It will be seen that in regions 36, between adjacent sections of the slotted sheet 10, the laminae 32 and 34 have filled the interstice, are touching, and are adhered to one another. This region 36 becomes a hinge for adjacent card sections as will be more fully explained below.

Figure 4:
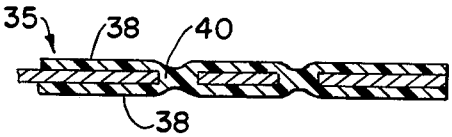
FIG. 4 shows in section an alternate construction in which slotted stock material has been coated on both sides with a plastic to cover the material and to fill the slots.

An alternative method may be used for forming the hinge. The slotted sheet 10 may be dipped, sprayed, or otherwise coated with a liquid plastic. This plastic must be applied in an amount to cause the surfaces of sheet 10 to become coated and the slots to become filled. Such a construction is shown in section at FIG. 4. A coating 38 of transparent plastic has been applied to both sides of slotted sheet 10. This coating has flowed into and filled the slots forming a hinge section 40.

Figure 5:
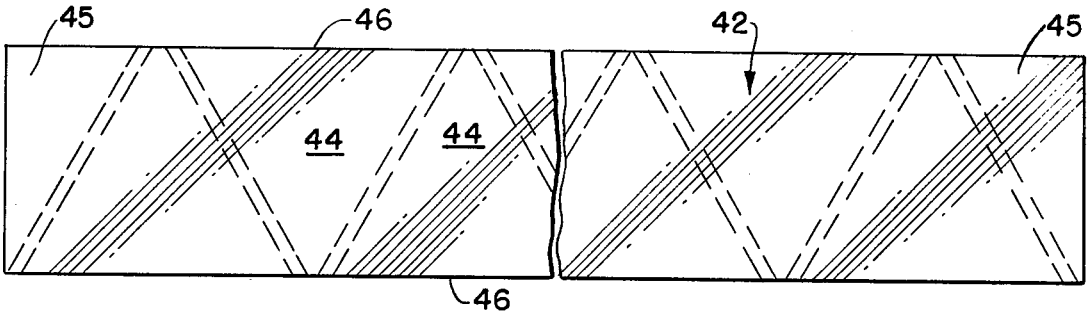
FIG. 5 shows a section of the sandwich which has been cut to form a row of adjacent triangles.

Turning now to FIG. 5, the coated sheet or sandwich 35 has been cut into strips 42. These strips are comprised of triangular sections 44 of sheet stock covered on both sides with transparent material. Here, for convenience, the complete strip is not shown but has been broken where indicated. In this embodiment, the strip 42 is shown with ends comprising right triangles 45. After the folding of the strip which is described in conjunction with FIGS. 7–10, these two right triangles 45 abut one another to form a single equilateral triangle. A bridging layer such as mylar tape is applied to both triangles to join them together. When this construction is used, the strip 42 comprises seventeen equilateral triangles 44 and two end right triangles 45.

In cutting the strips 42 from the sandwich 35 it is essential that the cutting tool intersect the adjacent ends of the sequential slots, and that the card segments 31 be removed. Cutting in this manner will serve to separate the slotted sheet into the plurality of adjacent triangle sections 44. This cutting may be done with a blade or a cutting wheel in which case the strip 42 is formed with straight edges 46.

Figure 6:
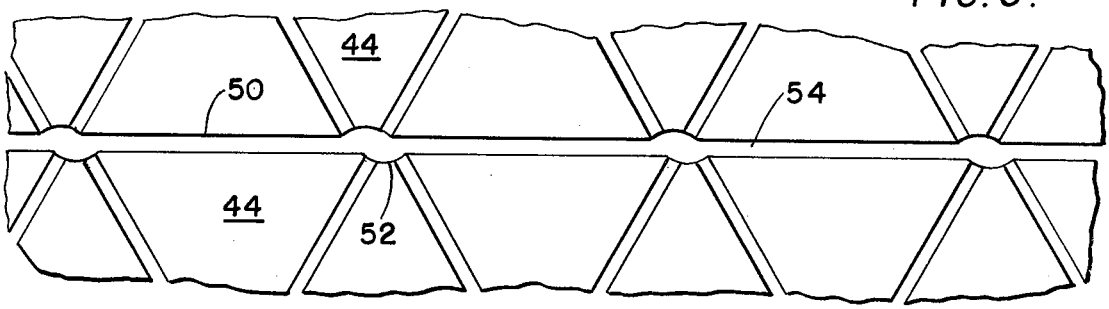
FIG. 6 shows an alternate cutting pattern produced by a die for forming rows of triangles.

Turning now to FIG. 6, an alternative embodiment is shown wherein the sandwich has been subjected to a die-cutting operation to form strips of adjacent triangles. The cutting pattern comprises straight sections 50 and rounded sections 52. The rounded cuts 52 castellate or remove the points from the triangles 44 and a waste portion 54 is formed.

Turning now to FIG. 7, a chain 55 comprising nineteen triangles is shown. In this embodiment, the first and last triangles of the chain will be adhered face-to-face in order to form the device. Beginning with the hinge 56 and continuing along the hinges 58, 60, 62, 64, 66, 68, 70 and 72, the strip is twisted in one direction and folded onto itself to produce the strip 73 shown in FIG. 8. This strip 73 can be described as a row of double triangles, that is, a row of triangles one folded upon another, with a single triangle on the extreme right end thereof. Strip 73 is then folded along the hinge 74 to produce the strip configuration 76 shown in FIG. 9. The strip portion comprising triangles 79, 80 and 81 is then folded under triangle 82 along the hinge 78. Triangle 81 is now directly beneath triangle 83. Triangle 84 is folded to a position between triangles 83 and 81 and triangles 81 and 84 are adhered together. The resulting structure is shown at FIG. 10. Six of the triangular sections 86 comprising the strip of FIG. 5 or FIG. 7 are arranged side-by-side to form a hexagon. The clear coating both covers and protects the printed triangles and forms hinge sections 88 therebetween.

Having thus described the device, obvious modifications will occur to those skilled in the art, which modifications are intended as forming a part of my invention as defined in the appended claims.

I claim:

1. A method for making a plurality of hexaflexagons from a single sheet of stock material comprising the steps of:

die cutting the single sheet to form a number of parallel rows of non-intersecting zigzag slots;

adhering a first transparent sheet to one face of said die-cut single sheet to form a sandwich;

cutting said sandwich to intersect said slots and divide said die-cut sheet into a plurality of disconnected strips of discreet individual equilateral triangle portions, said strips being equal in number to the number of parallel rows, said triangle portions being connected to one another solely by said transparent sheet; and folding each of said strips and connecting the first and last triangles of each of said strips together.

2. The method of claim 1 further comprising the steps of:

adhering a second transparent sheet to the opposite face of said die-cut sheet, and adhering said second transparent sheet to said first transparent sheet in the regions of said slots.

3. The method of claim 1 further comprising the steps of:

cutting the end triangle portion of each of said strips to form a strip of equilateral triangles with a single right triangle at either end thereof.

4. The method of claim 2 further comprising the steps of:

cutting the end triangle portion of each of said strips to form a strip of equilateral triangles with a single right triangle at either end thereof.

5. A method for making a plurality of hexaflexagons from a single sheet of stock material comprising the steps of:

die cutting the single sheet to form a number of parallel rows of non-intersecting zigzag slots;

coating said sheet with a liquid transparent material to form bridges in the regions of said slots;

cutting said coated sheet to intersect said bridges and divide said die-cut sheet into a plurality of disconnected strips of discreet individual equilateral triangle portions, said strips being equal in number to the number of parallel rows, said triangle portions being connected to one another solely by said bridges; and folding each of said strips and connecting the first and last of each of said strips together.

6. The method of claim 5 further comprising the steps of:

cutting said coated sheet along a curved line in the region of said bridges; and cutting said coated sheet along a straight line between said bridges.

7. A method for making a plurality of hexaflexagons from a single sheet comprising the steps of:

printing the sheet on at least one side thereof with indicia;

die cutting said sheet to form a plurality of parallel rows of non-intersecting zigzag slots, said slots being separated by a web portion;

coating said die-cut sheet on both sides thereof with first and second transparent sheets, said transparent sheets adhering to one another in the regions of said slots;

cutting said coated die-cut sheets along parallel lines to form a plurality of strips of individual discreet triangular segments connected together solely by said transparent sheets, said plurality of strips being equal in number to said plurality of parallel rows;

folding each of said strips to form a hexagonal stack; and fastening the first and last triangles of each of said strips together.

8. The method of claim 7 further comprising the steps of:

cutting said coated sheet to form triangular segments having castellated points.

* * * * *